US005840178A

United States Patent [19]

Huang et al.

[11] Patent Number: 5,840,178

[45] Date of Patent: Nov. 24, 1998

[54] HEAVY FEED UPGRADING AND USE THEREOF IN CAT CRACKING

[75] Inventors: Jean C. Huang; Belinda G. Lambeth, both of Baton Rouge, La.; Patrick H. Terry, Middletown; Daniel P. Leta, Flemington, both of N.Y.

[73] Assignee: Exxon Research and Engineering Company, Florham Park, N.J.

[21] Appl. No.: 666,168

[22] Filed: Jun. 19, 1996

[51] Int. Cl.[6] ..... C10G 17/00; C10G 29/04

[52] U.S. Cl. ..... 208/251 R; 208/253

[58] Field of Search ..... 208/251, 253

[56] References Cited

U.S. PATENT DOCUMENTS

| | | | |
|---|---|---|---|
| 3,904,550 | 9/1975 | Dine | 208/216 |
| 4,087,349 | 5/1978 | Baird, Jr. | 208/108 |
| 4,430,252 | 2/1984 | Ryu | 502/162 |
| 4,560,790 | 12/1985 | Ryu | 560/210 |
| 4,739,111 | 4/1988 | Ryu | 568/417 |
| 4,980,049 | 12/1990 | Huh et al. | 208/113 |
| 4,980,050 | 12/1990 | Huh et al. | 208/113 |
| 5,407,560 | 4/1995 | Miyawaki et al. | 208/106 |

*Primary Examiner*—Helane Myers
*Attorney, Agent, or Firm*—James H. Takemoto

[57] ABSTRACT

A heavy feed, such as a resid which contains coke precursors and metals, is upgraded by dissolving a feed soluble metal alkoxide in the feed which is heated to a temperature sufficient to decompose the alkoxide, but below 450° F. The alkoxide decomposition precipitates at least a portion of the coke precursors and metals out of the feed as a separate phase, thereby effectively removing them to form an upgraded feed. The upgraded feed, with or without the precipitate present, is then sent to a cat cracker or to other upgrading. When fed into a cat cracker, such as a FCC, the upgraded feed is converted to lower boiling liquids with less deactivation of the cracking catalyst than would occur if the metals and coke precursors remained in the feed, even with the precipitate present in the feed. In the cat cracker, the precipate which contains the alkoxide metal and coke precursors and metals from the feed, is converted into coke particles having a particle size smaller than the catalyst particles. This enables the coke particles to be separated from the spent catalyst particles via cyclone separation, so that the coke particles are not sent to the catalyst regenerator.

9 Claims, 2 Drawing Sheets

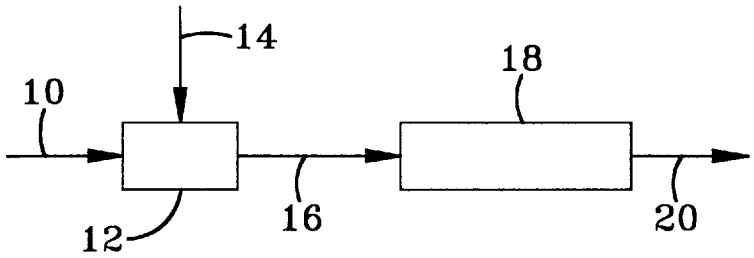
Fig. (1a)
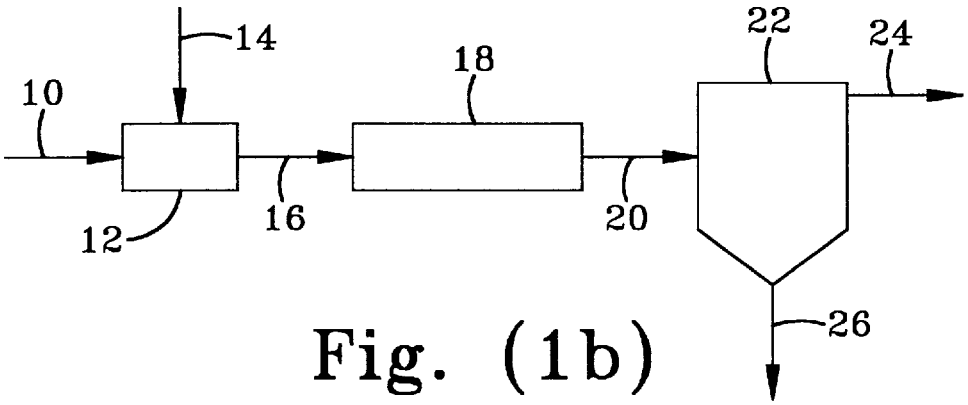
Fig. (1b)

HEAVY FEED UPGRADING AND USE THEREOF IN CAT CRACKING

BACKGROUND OF THE INVENTION

1. Field of the Invention

The invention relates to upgrading a heavy feed by removing coke precursors from the feed and to the use of the upgraded feed in catalytic cracking processes. More particularly, the invention relates to contacting a heavy feed containing metals and coke precursors with at least one feed-soluble metal alkoxide at a temperature sufficient to decompose the alkoxide which precipitates at least a portion of the coke precursors and metals as a separate phase, thereby effectively removing them to form an upgraded feed. The upgraded feed, with or without the precipitate, is then fed into a catalytic cracker where it is converted to lower boiling liquids with less deactivation of the cracking catalyst than would occur if the metals and coke precursors had not been precipitated from the feed.

2. Background of the Disclosure

Heavy atmospheric gas oil and vacuum gas oil distillate fractions derived from the atmospheric and vacuum distillation of crude petroleum oil have traditionally been used as feeds for catalytic cracking. The large differential value between asphaltene containing resids, such as atmospheric and vacuum tower bottoms, and an asphaltene free gas oil cat cracking distillate feed stock has given refiners an incentive to blend asphaltene containing stocks into catalytic cracking feed. However, asphaltenes and other heavy heteroatom and metals containing compounds, if present in a cat cracker feed, can seriously alter the selectivity and increase deactivation of the catalyst. This occurs by the metals, heteroatoms and coke precursors present in the resids being deposited on the catalyst during the cracking process.

Catalytic cracking, or cat cracking as it is commonly referred to, is an established and widely used process in the petroleum refining industry for converting petroleum oils of relatively high boiling point to more valuable lower boiling products, including gasoline and middle distillates, such as kerosene, jet fuel and heating oil. The preeminent catalytic cracking process now in use is the fluid catalytic cracking process (FCC) in which a preheated feed is brought into contact with a hot cracking catalyst which is in the form of a fine powder, typically having a particle size range of from about 10–300 microns and with a mean particle size of about 70–100 microns, for the desired cracking reaction to take place. The catalyst is fluidized by the hydrocarbon vapors. Catalysts which are conventionally used are based on zeolites, especially the large pore synthetic faujasites, zeolites X and Y. During the cracking, coke and hydrocarbonaceous material are deposited on the catalyst particles. This results in a loss of catalyst activity and selectivity. The coked catalyst particles and associated hydrocarbon material are subjected to a stripping process, usually with steam, to remove as much of the hydrocarbonaceous material as is technically and economically feasible. The stripped catalyst particles, containing non-strippable coke, are removed from the stripper and sent to a regenerator where they are regenerated by contact with an oxygen-containing gas, typically air or a mixture of air and oxygen, at an elevated temperature. This results in the combustion of the coke which is a strongly exothermic reaction which, besides removing the coke, serves to heat the catalyst to the temperatures appropriate for the endothermic cracking reaction. The process is carried out in an integrated unit which comprises cracking, stripping and regenerating zones and associated ancillary equipment. Typically the cracking and stripping zones are associated with a single vessel or unit, with the regenerator being a separate unit. The catalyst is continuously circulated from the reactor or reaction zone, to the stripper and then to the regenerator and back to the reactor. The catalyst circulation rate is typically adjusted relative to the feed rate of the oil to maintain a heat balanced operation in which the heat produced in the regenerator is sufficient for maintaining the cracking reaction, with the circulating regenerated catalyst being used as the heat transfer medium.

The most common feed stocks used with FCC processes are gas oils, that is, high boiling, non-residual oils, with an initial boiling point usually above about 230° C. (446° F.), more commonly above about 350° C. (662° F.), and with end points of up to about 620° C. (1148° F.). Typical gas oils include straight run (atmospheric) gas oil, vacuum gas oil, and coker gas oils. While there is a strong incentive for blending residual feed stocks (resids) with heavy gas oils to convert them into lower boiling liquid products, resids and any other feeds which contain asphaltenes and other heteroatom and metals containing materials can contain orders of magnitude higher levels of metals (e.g., vanadium and nickel), sulfur and nitrogen containing heteroatom compounds, and coke forming precursors than lighter, asphaltene free distillate feeds. The presence of nickel on an FCC catalyst creates an unwanted dehydrogenation function and vanadium adversely effects zeolites. Heavy coke make on the catalyst places a severe burden on the catalyst regenerator and makes the regenerator run too hot. As is known to those skilled in the art, this reduces the useful life of the catalyst and can also require that the regenerator have heat transfer means for cooling the overly hot, regenerated catalyst.

Removal of the asphaltenic portion of a resid feed also removes much of the metals, sulfur, nitrogen and coke precursors from the feed. However, known deasphalting processes such as clay absorption and solvent deasphalting with propane are expensive, requiring additional treating units, and large quantities of solvent and clay. In a clay absorption process a residual oil feed mixes with hot clay which separates the vaporizables, including a cracked fraction, from the non-vaporizables which remain on the clay, are burned off, and the clay recycled. A fluidized bed-regenerator system is used. This process produces large quantities of gas products and coke at the expense of more useful liquids. Past attempts to prevent metal deposition on a cat cracking catalyst have included introducing particulate matter such as coke or alumina particles into the cracking zone and also adding alumina particles to the cracking catalyst, as disclosed in U.S. Pat. Nos. 4,980,049 and 4,980,050. However, mixing alumina particles with the cracking catalyst effectively dilutes it. U.S. Pat. No. 5,407,560 discloses processing a heavy feed by thermally cracking it in the presence of a rare earth metal compound to produce a coke fuel and cracked products. However, this thermal cracking process produces large amounts of coke for fuel, less valuable liquid products and more gas than cat cracking. Consequently, a need exists for a method or process for introducing a heavy, asphaltene containing feed such as a resid into a fluidized catalyst cracking process without adversely effecting the catalyst, the cracking-regeneration process and without increasing the load or duty on the catalyst regenerator.

SUMMARY OF THE INVENTION

It has now been discovered that if a heavy feed, such as a resid, containing coke precursors and metals in the form of asphaltenes and other heteroatom compounds, is contacted with a feed soluble metal alkoxide at a temperature effective to decompose the alkoxide, the alkoxide decomposes and forms a precipitate containing asphaltenes, metals and other coke precursors present in the feed as a separate phase, thereby effectively removing them from the feed to form an upgraded feed. Thus, one embodiment of the invention relates to removing coke precursors and metals from a heavy feed by contacting the feed with at least one feed soluble metal alkoxide at a temperature sufficient to decompose the alkoxide and precipitate metals, asphaltenes and other coke precursors out of the feed, thereby effectively removing them from the feed to form an upgraded feed. By contacting the feed with a feed soluble metal alkoxide at a temperature effective to decompose the alkoxide, is meant that the alkoxide is dissolved in the feed and the solution of alkoxide containing feed is then heated to an effective alkoxide decomposition temperature, or the alkoxide or a solution of the alkoxide is added to, and dissolves in, the heavy feed which is already at an effective alkoxide decomposition temperature. In either case, the contacting occurs between the heavy feed and the alkoxide dissolved in it. Thermal decomposition of the alkoxide results in the formation of a precipitate in the feed. This precipitate is dispersed in the feed as micron size particles which comprise the alkoxide metal and coke precursors, metals and sulfur and nitrogen containing heteroatom compounds present in the feed. The upgraded feed, with or without the precipitate, is then fed into a catalytic cracker where it is converted to lower boiling, more valuable liquid products or is sent to other processing for further upgrading. It has been found, and forms a part of the invention, that in addition to cracking the upgraded liquid feed into lower boiling liquid products, contacting an upgraded feed which contains the precipitate with an FCC cat cracking catalyst at cat cracking temperatures also cracks a portion of the hydrocarbons present in the precipitate into liquid and gas products and forms fine particles of coke with less deactivation of the cracking catalyst than will occur if the metals and asphaltenes have not been precipitated. Thus, the metals and coke precursor containing precipitate effectively prevents at least a portion of these precipitated components from being deposited on the cracking catalyst during the cracking process, even though the precipitate is present in the cracking zone along with the upgraded feed. The metals precipitated from the feed, along with the alkoxide metal or metals are present in the coke particles formed during the cracking reaction. The coke particles formed by catalytically cracking the precipitate in the cracking zone are smaller than the particulate cracking catalyst. This enables them to be separated from the spent catalyst in cyclones and removed from the cracking unit along with the product vapors. Coke particles formed from cat cracking the precipitate particles have an average size generally less than 15 microns, typically less than 10 microns and often less then 5 microns. The process of the invention enables resids to be part of an FCC feed with significantly less catalyst deactivation, regenerator duty and reduction of catalyst life than will occur if the metals, coke precursors and sulfur and nitrogen containing heteroatom compounds are not precipitated.

The thermal decomposition temperature of the metal alkoxide used in the process of the invention is below the thermal cracking temperature of the precipitated coke precursors. Thus, in the process of the invention the thermal decomposition of the metal alkoxide present in the feed occurs at a temperature below 450° C. and preferably no greater than 400° C. (e.g., typically 25°–400° C.). By heavy feed is meant any feed which contains metals and coke precursors such as asphaltenes, maltenes, asphalts or bitumens, and other polynuclear aromatic and heteroatom compounds and the like, including those which will deposit and form coke on a cat cracking catalyst under cat cracking conditions. Metal alkoxides useful in the practice of the invention must be soluble in the feed and decompose in it at a temperature below 450° C., preferably below 400° C., to precipitate out at least a portion of the metals and coke precursors present without significant thermal cracking of the feed. Decomposition of the metal alkoxide forms a precipitate which contains the alkoxide metal, along with metals and coke precursors precipitated out of the feed. The metal alkoxide should not have an adverse effect on either a cat cracking catalyst or process in an embodiment in which the upgraded feed containing the precipitated metals and coke precursors is fed into a cat cracker. Metal alkoxides useful in the practice of the invention therefore exclude alkoxides of Group IA metals. Illustrative, but non-limiting examples of metal alkoxides useful in the process of the invention include, for example, feed soluble alkoxides of Al, Si, Ti, Zr, Mg and Ce. Alkoxides selected from the group consisting essentially of Al, Si, Ti and Zr are preferred and one or more of Si and Al alkoxides are particularly preferred. Those skilled in the art will appreciate that silicon (Si) is considered to be a metal in the ordinary sense of the term, but not in the exact sense as it is electrically semiconducting. In the context of the invention silicon is referred to as a metal for the sake of convenience.

In its broadest sense the invention relates to a process for upgrading a feed containing metal and coke precursors which comprises contacting the feed with an effective amount of feed soluble metal alkoxide at a temperature and for a time sufficient to decompose said alkoxide and precipitate at least a portion of said metals and coke precursors from the feed, which effectively removes them from the feed, to form an upgraded feed. The metal alkoxide is at least one alkoxide of at least one metal and decomposes at a temperature below 450° C. and preferably no greater than 400° C. Thus the decomposition temperature will broadly range between 25°–450° C., preferably 25°–400° C. By effective amount of metal alkoxide is meant an amount effective to precipitate at least a portion of the metal and coke precursors from the feed. In general, this will be be from 0.05–10 wt. % of the heavy feed. In further embodiments the upgraded feed is sent to additional processing with or without the presence of the precipitate. In a particularly useful embodiment, the upgraded feed containing the precipitate is fed into a FCC wherein it is converted to lower boiling liquid products and fine coke particles smaller than the catalyst particles, with the coke particles being separated from the catalyst particles in cyclones and passing out of the FCC unit along with the product vapors, instead of being sent to the regenerator with the spent catalyst which would increase the load on the regenerator. In yet other embodiments the precipitate is separated from the upgraded feed, with the precipitate and feed sent to separate upgrading processes.

BRIEF DESCRIPTION OF THE DRAWINGS

FIGS. 1 (*a*) and 1 (*b*) are simple block diagrams respectively illustrating the metals and coke precursor precipitation process of the invention with and without separating the precipitate from the upgraded feed.

DETAILED DESCRIPTION

Figure 2:
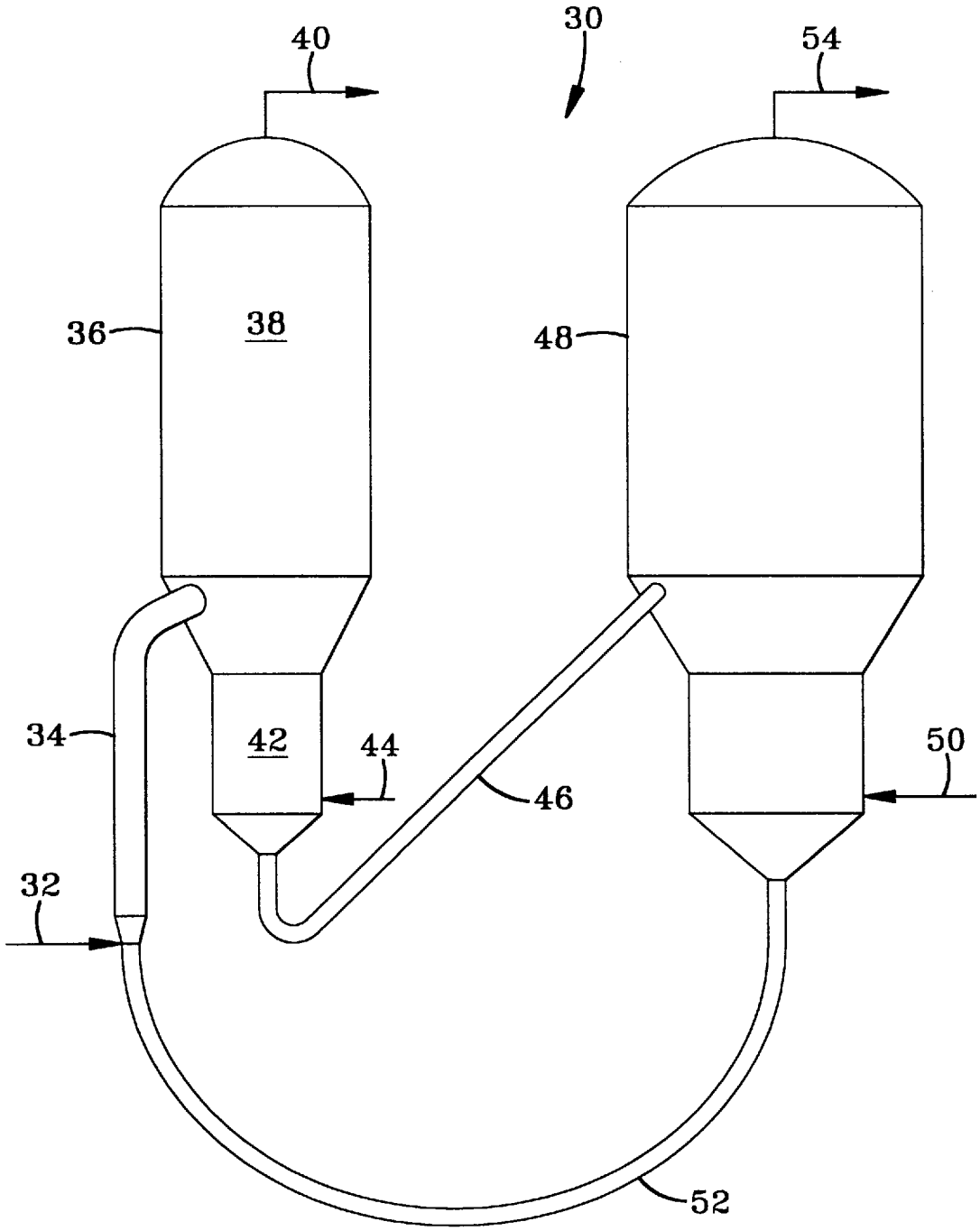
FIG. 2 schematically illustrates an embodiment of the invention in which a feed upgraded according to the invention is fed into an FCC unit, such as a Flexicracker®.

Referring to FIG. 1 (*a*), an FCC feed comprising a mixture of a vacuum gas oil (VGO) and a heavy feed, such as a resid, which contains metals and coke precursors, is fed through line 10 into a mixing zone 12. A solution of VGO or other suitable solvent in which is dissolved an effective amount of metal alkoxide useful in the practice of the invention is introduced into mixing zone 12 via line 14 wherein it mixes with the feed by suitable means (not shown). Mixing zone 14 may be a separate vessel or a portion of the FCC feed line containing static or other mixing means. Both the FCC feed and the VGO alkoxide solution are at a temperature below the alkoxide decomposition temperature. The FCC feed containing the dissolved metal alkoxide is passed from zone 12 to heating zone 18 via line 16. In heating zone 18, which is an indirect heat exchanger, the feed mixture is heated to a temperature effective to decompose the metal alkoxide and form a precipitate and an upgraded feed. The upgraded feed containing the precipitate is removed from zone 18 via line 20 and sent to further upgrading, such as a FCC. The feed containing the dissolved alkoxide is heated to a temperature effective to decompose the alkoxide, but below 450° C. and preferably no greater than 400° C. Those skilled in the art will appreciate that thermal cracking begins to occur at temperatures generally from 400°–450° C., more typically closer to 400° C. It is an aspect of this invention to avoid or at least minimize thermal cracking of any of the feed components or precipitated coke precursors, inasmuch as thermal cracking produces relatively large quantities of gas and coke and relatively small quantities of useful liquid products. In an embodiment in which the upgraded feed, with or without the precipitate, is fed into a cat cracker or FCC, the feed temperature is typically from 80°–150° C. for a "cold" feed and 150°–300° C. for a "hot" feed. The precipitate comprises the decomposed metal alkoxide along with metals and coke precursors removed from the feed. Thus the precipitate contains feed metals such as vanadium, nickel, iron, etc., coke precursors and sulfur and nitrogen initially present in the heavy feed.

In another embodiment (not shown), a lighter feed, such as a VGO or the like which contains the metal alkoxide dissolved in it, is mixed with a heavy feed which contains metals and coke precursors, with the heavy feed at a temperature effective to decompose the alkoxide and thereby form the precipitate and an upgraded feed. The feed can be a straight heavy feed such as a resid and the like or it can be a heavy feed mixed with a lighter fraction such as a VGO and the like. The upgraded feed is then fed into a FCC as part of the FCC feed or sent to other processing. The metal alkoxide may be mixed with a suitable solvent, such as toluene, and mixed directly with the heavy feed. Other methods for mixing and contacting the heavy feed with the metal alkoxide to upgrade a heavy feed according to the practice of the invention may be used by those skilled in the art.

The process illustrated in FIG. 1 (*b*) is similar to that of the process illustrated in FIG. 1 (*a*), except that the upgraded feed containing the precipitate is passed via line 20 to separation zone 22 in which the precipitated particles are separated from the upgraded feed in separation zone 22 and removed via line 26, with the precipitate free upgraded feed removed from zone 18 via line 24 and sent to further processing, such as a cat cracking unit or other processing. The separated precipitate is also sent to further processing, which can include steam separation to remove liquids, followed by cracking at temperatures of 400° C. and greater, as is known to those skilled in the art. The nature of the cracking (e.g., catalytic, thermal or mixture thereof) is determined by the nature of the alkoxide metal or metals and whether or not they possess an acid function. If desired, the precipitate is passed to a fluid coker, such as a Flexicoker®. Separation zone 22 may include simple settling, filtration, distillation, decanting with or without the addition of lighter fractions as a viscosity reducer, supercritical extraction, solvent deashing, centrifugation, steam distillation plus cyclone or electrostatic separation, etc., as is known to those skilled in the art.

FIG. 2 is an illustrative, but nonlimiting example of a further embodiment of the invention in which a feed upgraded according to the process of the invention is upgraded in an FCC unit 30, which is shown as a Flexicracker®. Turning now to FIG. 2, a preheated cat cracker feed is fed via line 32 into the base of riser 34 of the fluidized cat cracking reactor 36. The feed comprises a mixture of a VGO and a resid fraction which has been upgraded according to the precipitation process of the invention and which contains the particulate precipitate comprising metals and coke precursors. The feed is contacted with particles of hot cracking catalyst (not shown) in the riser which vaporizes and cracks the feed into lighter, lower boiling fractions, including fractions in the gasoline boiling range (typically 100°–400° F.). The cat cracking catalyst is a mixture of silica and alumina containing a zeolite molecular sieve cracking component as is known to those skilled in the art. The cracking reactions start when the feed contacts the hot catalyst in the riser and continues until the vapors are separated from the catalyst in the upper or disengaging section 38 of cat cracker 36. Typical cat cracking conditions include a temperature of from about 800°–1200° F. (425°–650° C.), a pressure between about 5–50 psig and feed/catalyst contact times between about 0.5–15 seconds as is known to those skilled in the art. It is a significant feature of this embodiment of the invention that the precipitated coke precursors form cracked hydrocarbon products and fine particles of coke (coke dust) which contain the precipitated metals, thereby reducing the amount of metals and coke precursors deposited onto the cracking catalyst from what it would be if the metals and coke precursors had not been precipitated out of the feed. Reactor 36 contains cyclones (not shown) in the disengaging section 38 which separate both the cracked hydrocarbon product vapors and the coke dust resulting from cracking the precipitated coke precursors, from the spent catalyst particles. The fine particle size of the coke dust enables it to be separated from the significantly larger coked catalyst particles, thereby reducing the coke and metals loading to the regenerator from what it would be if the coke and metals from the precipitate went to the regenerator along with the spent catalyst. The hydrocarbon vapors and coke dust pass up through the reactor and are withdrawn via line 40. In one embodiment the hydrocarbon vapors and coke dust are fed into a condenser (not shown) and then to a distillation unit or column (not shown) which condenses the condensible portion of the vapors into liquids and fractionates the liquids into separate product streams, with the coke dust withdrawn from the tower as part of the bottoms liquids. In another embodiment the cracked product vapors and gas containing the coke dust pass through additional cyclone separators or other suitable means of separation, either inside or outside the reactor 36, to separate the coke dust from the vapors before the vapors are passed into a condenser. In essence, this embodiment enables a resid upgraded by the process of the invention to be fed into a FCC as part of the lighter FCC feed, while minimizing the additional loading of the regenerator and catalyst deactivation that would normally occur with resid in the feed.

In this embodiment of the invention in which the mixed feed containing the precipitated coke particles is fed into a cat cracker, the hot cracking temperature cracks the alkane portions of the coke precursor particles or microdroplets into primarily liquid product and cracks other crackable hydrocarbonaceous material present in the coke precursor particles to liquid and gas products, leaving a very fine particle size coke residue (coke dust) having high concentrations of the metals, sulfur and nitrogen compounds initially present in the heavy feed portion. While not wishing to be held to any particular theory it is believed that, depending on the nature of the metals in the alkoxide and those precipitated from the heavy feed component, the cracking of both the alkane and nonalkane portions of the coke precursors in a catalytic cracker may be a combination of both catalytic and thermal cracking. It is preferred in this embodiment that the metals present in the coke precursor particles have an acid function to yield more liquid product and less gas than would be obtained with strictly thermal cracking. The coke dust also contains oxides of the metal or metals which were present in the alkoxide. As is set forth above, cyclone separation of the coke dust from the spent cat cracker catalyst particles is a result of the particle size difference between the coke dust and the significantly larger spent catalyst particles.

The spent catalyst particles fall down into stripping zone 42 in which they are contacted with a stripping medium, such as steam, which is fed into the stripping zone via line 44 and removes the hydrocarbonaceous material deposited on the catalyst during the cracking reactions. The stripped catalyst particles are removed from the bottom of the stripping zone via transfer line 46 and passed into regenerator 48 in which they are contacted with air entering via line 50. The air burns off the carbon deposits to regenerate the catalyst particles and in so doing, heats them up to a temperature of about 1100°–1500° F. (590°–816° C.). The hot, regenerated catalyst particles are transferred back to the cat cracker via transfer line 52 and into riser 34, wherein they contact and vaporize the feed entering riser 34 from line 32. Flue gas comprising mostly $CO_2$ is removed from the top of the regenerator via line 54.

The process of the invention is useful for removing coke precursors and associated metals from any feed which contains these components. These components are present in heavy feeds which typically boil above about 950° F. (500° C.) by which is meant any feed which contains metals and coke precursors such as asphaltenes, maltenes, asphalts or bitumens, and other polynuclear aromatic and heteroatom compounds and the like which contain metals and form coke on a cat cracking catalyst under cat cracking conditions. These coke precursors include those determined by the ASTM Test Method D 4530-93, Standard Test Method for Determination of Carbon Residue (Micro Method). These test results are equivalent to the Conradson Carbon Residue Test (ASTM Test Method D 189). Some of the sulfur and nitrogen present in such feeds is also present in these components and is removed along with the coke precursors and metals. Heavy feeds containing these coke precursors and metals which are upgraded by the process of the invention include any conventionally known heavy hydrocarbonaceous materials including whole and reduced crudes, resids or residua from atmospheric and vacuum distillation of crude oil, asphalts and asphaltenes, tar oils and cycle oils from thermal or catalytic cracking of heavy petroleum oils, tar sand oil, shale oil, coal derived liquids, syncrudes and the like. These materials typically contain from about 1–25 wt. % asphaltenes, 5–30 wt. % residual or Conradson carbon materials and 2–2000 ppm of vanadium, along with iron, nickel, sodium, other metals and sulfur and nitrogen containing components. In practicing the upgrading process of the invention, due to the high viscosities of these heavy hydrocarbonaceous materials, they will generally be mixed or blended with lighter feeds, such as cat cracker feeds or a suitable solvent, to facilitate mixing of the metal alkoxide with the heavy feed and also enable more facile handling, pumping and processing. Cat cracker feeds are desirable as a heavy feed diluent and as a solvent for the metal alkoxide in embodiments in which the upgraded heavy feed is to be fed to a cat cracker. These typically include gas oils or high boiling non-residual oils such as a vacuum gas oil (VGO) and a light cat cracker oil (LCGO), with an initial boiling point typically above about 450° F., and with end points up to about 1150° F., as well as straight run or atmospheric gas oils and coker gas oils. In this embodiment, the heavy feed to be upgraded according to the process of the invention is typically blended with such a lighter fraction in an amount broadly ranging from about 2 to 75 volume % of the heavy feed based on the total blend, and more generally from about 5–30 volume %. The lighter fraction may or may not contain the metal alkoxide already dissolved in it prior to being blended with the heavy fraction. and the solution of blended feed and metal alkoxide then heated to decompose the alkoxide and upgrade the heavy feed component of the blend. Blending of the heavy feed and lighter distillate fraction may be accomplished without the presence of the alkoxide in the lighter fraction and the alkoxide then dissolved directly into the cold or hot blend. As a practical matter it is more convenient to dissolve the alkoxide in a lighter fraction and add the so-formed alkoxide solution to the blend.

An effective amount of metal alkoxide useful in the practice of the invention will broadly range from about 0.1–10 wt. % alkoxide based on the feed, more generally 0.2–6 wt. % and typically 0.5–5 wt. % depending on the feed, alkoxide metals and extent of upgrading desired. The actual amount used is at the discretion of the practitioner. X-ray photoelectron studies of precipitate formed in an autoclave have revealed the presence of C, O, N, Si, Al, S, Ni and Fe in the precipitate when a mixture of Al and Si alkoxides was used to upgrade a resid containing feed. Thus, the precipitate contained the Al and Si alkoxide metals and oxygen, in addition to carbon, sulfur, nitrogen, nickel and iron from the feed. While not wishing to be held to any particular theory, it is believed that when the alkoxide or alkoxides decompose, an oxide or mixed oxide is formed from the alkoxide metals and oxygen, along with metals and coke precursors from the feed. Illustrative, but non-limiting examples of metal alkoxides which have been found to be useful in the process of the invention include, for example, feed soluble alkoxides of Al, Si, Ti, Zr, Mg, Ce, other rare earth metals, Group IIA metals and the like, and mixtures of two or more metals. In the embodiment in which the upgraded feed is to be fed into a cat cracker, it is preferred to use metal alkoxides of elements already present in the FCC environment (e.g., Si, Al, Ti and rare earths). This avoids introducing new contaminants into the FCC unit. In one embodiment alkoxides selected from the group consisting essentially of Al, Si, Ti and Zr are preferred and one or more of Si and Al alkoxides are particularly preferred. The alkoxide may be an alkoxide of one metal or two or more metals and more than one metal alkoxide can be used.

Illustrative, but nonlimiting examples of metal alkoxides suitable for use in the practice of the invention include di-s-butoxyaluminoxytriethoxysilane, methyltris(tri-s-butoxysiloxanyl)silane, aluminum tri-s-butoxide, tetraethoxysilane, diethyldiethoxysilane, amyltriethoxysilane, benzyltriethoxysilane, 2-(3-cyclohexenyl)ethyltrimethoxy-silane, dicyclohexyldimethoxysilane, diisobutylsilanediol, n-dodecyltriethoxy-silane, n-hexadecyltriethoxysilane, n-hexyltrimethoxysilane, tetrabutoxysilane, tetrakis (2-ethylhexaoxybutoxy)-silane, pentlytriethoxysilane, methyl(tris-s-butoxysiloxanyl)silane, isobutyltrimethoxysilane, methyldodecyldiethoxysilane, titanium(IV) ethoxide, titanium(IV) 2-ethylhexoxide, zirconium n-butoxide, zirconium t-butoxide, cerium(IV) t-propoxide and the like.

The invention will be further understood by reference to the examples below.

EXAMPLES

In the following examples, except for the autoclave experiments, cracking tests were conducted in a microactivity test (MAT) unit. The MAT unit and test are a recognized standard in the industry and are described by Ciapetta and Henderson in the Oil and Gas Journal, v.65, n.72 (1967) and in p.60–68 of the Nov., 1971 issue. Run conditions in the MAT unit were as follows:

| | |
|---|---|
| Temperature, °F. | 950 (510° C.) |
| Run time, Sec. | 40 |
| Catalyst charge, gm. | 5 |
| Amount feed, gm. | 1.8 |
| Cat/Oil wt. ratio | 2.7 |

The MAT tests were made with a catalyst at equilibrium conditions taken from an operating refinery FCC unit. The catalyst was a commercially available cat cracking catalyst comprising an alumina sol containing a zeolite component and minor amounts of rare earth metal components.

EXAMPLES 1–2

These experiments were conducted in a batch autoclave with 100 g of feed or 100 g of feed plus metal alkoxide. The feeds were prepared one day prior to the autoclave runs. The autoclave was run at 200° C. under nitrogen, with each run lasting 1.5 hours. The feed was a 50:50 blend of a VGO FCC cracker feed ( 650°–1050° F.) and a Venezuelan atmospheric resid. In one run which was the control, no metal alkoxide was present. Under these conditions no precipitate resulted for the control which did not contain a metal alkoxide. However, the autoclave run containing 3 wt. % of di-s-butoxyaluminoxytriethoxysilane (DBATES) metal alkoxide yielded about 4 wt. % of a toluene insoluble precipitate. Analysis of the precipitate showed 47 wt. % pyrolizable at temperatures below 530° C. in an inert atmosphere. This means that this material will crack-off under FCC riser conditions. About 30 wt. % of the precipitate was coke in that oxygen was required to burn off the carbonaceous material. After burning, 23 wt. % ash remained. The properties of the blended feed without (control) and with the metal alkoxide present after the autoclave runs are shown below, along with the calculated properties of the organic portion of the precipitate obtained using the alkoxide additive, based on the difference in feed properties of the control and plus alkoxide runs.

| | Feed Control | Feed Plus Alkoxide | Organics of Precipitate |
|---|---|---|---|
| Concarbon, wt. % | 5.3 | 4.3 | 32 |
| Sulfur, wt. % | 1.6 | 1.5 | 4 |
| Ni, ppm | 15 | 11 | 143 |
| Fe, ppm | 16 | <1 | 481 |
| V, ppm | 125 | 92 | 1072 |
| N, basic, ppm | 440 | 393 | 1528 |
| Na, ppm | 28 | 4 | 78 |

MAT runs using the autoclaved feed with the micron sized precipitate intact in the feed yielded cracked products very similar to that observed with MAT runs using feed containing 3 wt. % of the DBATES which was not preautoclaved. Both of these runs performed significantly better than the control feed without the DBATES.

EXAMPLES 3–8

In these experiments, 0, 1, 2, and 3 wt. % of di-s-butoxyaluminoxy-triethoxysilane, a bimetal alkoxide containing both Al and Si, was added to a feed which was a 50:50 volume mixture of a vacuum gas oil cat cracker feed boiling within the range of from 650°–1050° F. (340°–565° C.) and an atmospheric resid derived from a Venezuelan crude and having an initial boiling point of 650° F. (343° C.) and containing about 9 wt. % of coke precursors. The feed mixture containing the dissolved alkoxide was stirred for 18 hours at 70° C. prior to testing in the MAT unit using the equilibrium fluid cat cracking catalyst described above. The feed properties were as follows:

| | VGO | Resid |
|---|---|---|
| Concarbon, wt. % | 0.18 | 9.12 |
| Sulfur, wt. % | 0.984 | 2.166 |
| Vanadium, ppm | 0.34 | 255.4 |
| Nickel, ppm | 0.41 | 28.9 |

The MAT test results indicated decreased specific coke and increased 430° F. (220° C.) conversion (conversion to liquid fractions boiling below 430° F.) for the feed containing the 3 wt. % bimetal alkoxide. Since the mixed feed had an initial boiling point of 650° F., products in the $C_5$–430° F. range came from cracking reactions. The low material balance indicated that precipitation of the coke precursors occurred in the MAT feed preheating line. The precipitated material resulted from the asphaltenes and other coke precursor portions of feed which would have resulted in coke-on-catalyst and 650+° F. cracked feed weight fractions. The mass balance below indicates that approximately 8 wt. % of the original feed, which contained the 3 wt. % alkoxide and an average of 4.7 wt. % Concarbon, was removed in the precipitate. Specific coke values are defined as the wt. % coke divided by [x/(1−X)], wherein X=430° F. conversion.

MAT MATERIAL BALANCE RESULTS

| Wt. % Alkoxide | Balance | Specific Coke | 430° F. Conversion | Wt. % 650+ ° F. |
|---|---|---|---|---|
| 0 | 100.5 | 11.00 | 63.51 | 18.53 |
| 0 | 101.2 | 8.83 | 62.70 | 18.67 |
| 1 | 98.1 | 8.19 | 61.83 | 19.00 |
| 1 | 98.2 | 9.31 | 64.14 | 17.12 |

-continued

| Wt. % Alkoxide | Balance | Specific Coke | 430° F. Conversion | Wt. % 650+ ° F. |
|---|---|---|---|---|
| 2 | 98.7 | 8.05 | 67.41 | 14.21 |
| 2 | 97.4 | 7.44 | 65.47 | 15.67 |
| 3 | 91.5 | 3.77 | 66.15 | .85 |
| 3 | 93.2 | 4.34 | 66.55 | 14.98 |

EXAMPLES 9–14

These experiments were almost identical to those of the MAT runs above, except that a small piece of quartz wool was used to divide the catalyst bed in half. This permitted separate catalyst measurements to be made on the top and bottom of the bed. The wt. % coke formed on the catalyst in the bed as a function of the amount of DBATES metal alkoxide present in the feed is set forth in the Table below.

| WEIGHT % COKE | | |
|---|---|---|
| Wt. % Alkoxide | Top Bed | Bottom Bed |
| 1 | 3.21 | 1.60 |
| 1 | 2.67 | 1.52 |
| 2 | 3.15 | 1.60 |
| 2 | 2.59 | 1.53 |
| 3 | 1.62 | 1.50 |
| 3 | 1.47 | 1.47 |

These results confirm that the most asphaltenic portions of the feed were selectively precoked according to the process of the invention at the 3 wt. % alkoxide additive level. At the 3 wt. % alkoxide level, the absolute wt. % of coke-on-catalyst on the top half of the catalyst bed was essentially the same as that on the bottom half of the bed. This indicates that the coke on the catalyst was catalytic coke from the catalytic cracking of the liquid feed and not due to coking of asphaltenic material.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A process for upgrading a feed containing metal and coke precursors which consists essentially of contacting said feed in the absence of added hydrogen with an effective amount of feed soluble metal alkoxide containing at least one metal selected from the group consisting essentially of Al, Si, Ti, Zr and rare earth metal at a temperature and for a time sufficient to decompose said alkoxide and precipitate at least a portion of said metal and coke precursors from said feed, thereby effectively removing said metal and precursors from said feed and forming an upgraded feed.

2. A process according to claim 1 wherein said precipitate contains said alkoxide metal.

3. A process according to claim 2 wherein said alkoxide decomposition, precipitation and contacting occur at a temperature below 450° C.

4. A process according to claim 3 wherein said temperature is no greater than 400° C.

5. A process according to claim 4 wherein said metal alkoxide is present in said feed in an amount between 0.1–10 wt. %.

6. A process for upgrading a heavy feed containing coke precursors and metals which comprises the steps of:

(i) contacting said feed with a thermally decomposable alkoxide in the absence of added hydrogen, said alkoxide consisting essentially of a feed soluble metal alkoxide of at least one metal selected from the group consisting essentially of Al, Si, Ti, Zr and rare earth metal at a temperature sufficient to decompose said alkoxide, but below 450° F., to precipitate at least a portion of said metals and coke precursors present in said feed, thereby effectively removing them from said feed to form an upgraded feed, wherein said precipitate contains said coke precursors, alkoxide metal and said metal precipitated from said feed;

(ii) passing said upgraded feed and said precipitate into a cat cracking zone in the presence of a particulate cracking catalyst and in the absence of added hydrogen at a temperature sufficient to crack said feed into lighter hydrocarbon product vapors and to produce coked catalyst particles and particles of coke from said precipitate, wherein said coke particles contain said alkoxide and precipitated feed metals and have a particle size sufficiently smaller than the average particle size of said coked cracking catalyst to enable said coke to be cyclone separated from said catalyst;

(iii) separating said hydrocarbon product vapors and said coke particles from said coked catalyst particles, and (iv) withdrawing said products and coke particles from said cracking zone.

7. A process according to claim 6 wherein said coked catalyst particles are passed from said cracking zone into a regenerating zone.

8. A process according to claim 7 wherein the alkoxide deposition and precipitation occur at a temperature between 25°–400° C.

9. A process according to claim 6 wherein cracking comprises fluid cat cracking with a zeolite containing cat cracking catalyst.

* * * * *